US005887321A

United States Patent [19]

Foley, Jr.

[11] Patent Number: 5,887,321

[45] Date of Patent: Mar. 30, 1999

[54] BEREAVEMENT CASKET HAVING IMAGE RECEIVING SURFACE

[75] Inventor: George Leo. Foley, Jr., York, Pa.

[73] Assignee: The York Group, Inc., Houston, Tex.

[21] Appl. No.: 787,933

[22] Filed: Jan. 23, 1997

[51] Int. Cl.[6] ..... A61G 17/00

[52] U.S. Cl. ..... 27/2

[58] Field of Search ..... 27/2, 3, 4, 5, 6, 27/35, 20; 428/537.1

[56] References Cited

U.S. PATENT DOCUMENTS

| | | | |
|---|---|---|---|
| 1,388,426 | 8/1921 | Grieve | 27/2 |
| 4,729,928 | 3/1988 | Schiappa et al. | 428/537.1 X |
| 4,773,134 | 9/1988 | Kay | 27/14 |

*Primary Examiner*—Kien T. Nguyen
*Attorney, Agent, or Firm*—Liddell, Sapp, Zivley, Hill & LaBoon, L.L.P.

[57] ABSTRACT

A burial casket having an image receiving surface includes a container, a cover and a coating applied to the exterior surface of the casket for receiving images. The image receiving surface includes at least one layer of stain applied directly to the exterior surface of the casket, a shading toner applied on top of the stain, a lacquer sealer applied on top of the shading toner, and at least one layer of gloss lacquer applied on top of the lacquer sealer. The container has a rectangular central portion which forms the bottom of the casket, opposed end walls which form the ends of the casket, and opposed side walls which form the sides of the casket. The cover overlies the ends walls and the sides walls and is hingedly connected to one of the side walls for moving between an open position and a closed position. The casket also includes media for introducing the images on the image receiving surface. The media include ink, dye, plastic, chalk, paint, charcoal, decals and transfers. The media are applied to the image receiving surface with instruments such as pens, pencils, crayons, ink markers, paint brushes and aerosol spray containers. A method for forming the image receiving surface on the casket is also disclosed.

4 Claims, 2 Drawing Sheets

BEREAVEMENT CASKET HAVING IMAGE RECEIVING SURFACE

FIELD OF THE INVENTION

This invention relates to burial caskets and, more specifically, to burial caskets having an image receiving surface formed on the exterior surface thereof and to a method of manufacturing the same.

BACKGROUND OF THE INVENTION

A number of efforts have been made to attach information to gravestones, monuments and, in some instances, directly to burial caskets. The information typically concerns a decedent and comprises the decedent's name, date of birth, date of death, and perhaps a religious icon or some mention of significant achievements, etc. The information usually appears within the gravestone or monument or on a plaque or tablet which may be attached either to the monument or to the casket.

On caskets, one type of plaque conforms to the shape of a section of the casket and remains attached to the exterior surface of the casket after the decedent is entombed. Another type of plaque is attached to the casket when the decedent is laid-out for viewing, but it is later detached from the casket and placed inside the casket before burial.

For example, U.S. Pat. No. 2,835,014 to Dioguardi discloses a clip-like attachment device for temporarily securing a name plate to a casket, a vault or a similar structure. The attachment device comprises a lengthy base plate with an elongated slot adjacent to one of its ends. The base plate is affixed to the top surface of the casket with a screw and terminates at the opposite end thereof in outwardly turned pivots. A top plate member of the attachment device co-acts with a spring-tongue projection which is integral with the base plate. By utilizing the attachment device, the name plate may be quickly clipped in place or removed from the casket without causing any disturbance or noise during a funeral service.

U.S. Pat. Nos. 4,833,554 and 5,007,148 to Bida disclose a plaque which provides information about a decedent and is mounted to a casket. The plaque comprises a thin sheet of metal foil which is inserted in a typewriter to produce indentations thereon. Once a typewritten message has been imprinted onto the foil, it is mounted on a base and a layer of clear plastic is provided around the plaque. Once the plaque has been prepared, it is removably mounted on the casket and is disposed at a 45 degree angle for viewing by a person standing adjacent the casket. The patents also disclose a locking bracelet for permanently securing the plaque to the remains in the casket subsequent to the funeral ceremony and prior to burial. Although the '554 and '148 Patents enable information about the decedent to be memorialized on a plaque, the procedure for preparing the plaque is extremely complex and time consuming. The typewritten text must also be prepared by a trained individual, long before the plaque is displayed to the public.

While the above patents provide certain advantages with respect to displaying information about the decedent, none of the references enable an individual mourner or mourners to personally participate in the information generating process, particularly with respect to the content of the information. Mourners typically express their grief by sending sympathy cards or flowers to the decedent's family, or offering a eulogy at a wake or funeral service. Thus, there are a limited number of ways for mourners to express their emotions prior to, during, and after, a funeral service.

In view of the above, there is a clear need for a device which will enable mourners to simply, personally, freely and spontaneously express their grief by creating an image or message on the exterior surface of a casket. The device must be simple so that virtually all mourners can generate a desired image on a burial casket. In addition, the device must enable mourners to personally participate in generating the image on the casket so that they can each participate in their own way. There is also a need for a device which enables mourners to freely express themselves, in any manner they chose, unconstrained by the conventions of others. Finally, there is a need for a device which allows a mourner to spontaneously generate a message on the casket while bidding a "final farewell" to the decedent.

From the foregoing, it can be seen that it would be advantageous to provide a casket having an image receiving surface capable of receiving symbolic information in various forms. While there are a number of devices and methods for securing plaques to the exterior surface of caskets, there is presently no casket or method for enabling mourners to create an expression of grief or other emotion on the exterior surface of a casket.

Thus, it is an object of the present invention to provide a burial casket.

It is another object of the invention to provide a bereavement casket having an image receiving surface formed on the exterior portion of the casket.

It is still another object of the present invention to provide a bereavement casket having a medium for introducing permanent markings on the image receiving surface.

It is a further object of the invention to provide an aesthetically appealing bereavement casket.

It is still another object of the invention to provide a method for forming an image receiving surface on an exterior surface of a casket.

BRIEF SUMMARY OF THE INVENTION

The present invention achieves these and other advantages by providing a burial casket which has an image receiving surface formed on the exterior surface thereof. The image receiving surface is capable of having images formed thereon so mourners can easily, personally, freely and spontaneously create expressions of grief or other emotions on the casket. The casket comprises a container, a cover and the image receiving surface. The container has a bottom which is generally rectangular in shape, opposed ends walls and opposed side walls. The cover overlies the end walls and the side walls of the container and is hinged to one of the side walls so that at least a portion of the cover can be moved between an open position and a closed position.

The image receiving surface is a coating formed on the exterior surface of the casket. The coating includes a stain, a shading toner, and a lacquer. Specifically, the coating includes a first stain which is applied directly onto the exterior surface of the casket; a glazing stain applied on top of the first stain; a shading toner applied on top of the glazing stain; a lacquer sealer applied on top of the shading toner; and at least one layer of gloss lacquer formed on top of the lacquer sealer. The gloss lacquer is formulated to receive, more or less permanently, markings which form the image.

The invention also includes a method for applying a coating to the exterior surface of the casket. The coating is formed by first spraying at least one coat of stain on the exterior surface of the casket and allowing the stain to air dry. After the stain air dries, the entire exterior surface of the casket is wiped with a cloth. A shading toner is then used to spot paint the dried stain layer to cover any dark spots where the casket material, typically a hard wood, may show through the stain. Next, a coat of lacquer sealer is applied on top of the toner. After the lacquer sealer air dries, the exterior surface is scuff sanded and a first coat of gloss lacquer is applied. After the gloss lacquer air dries, the casket is once again scuff sanded. Finally, a second coat of gloss lacquer is applied and allowed to air dry. By using this method, a coating is formed on the exterior surface of the casket which is capable of receiving images.

A number of different media are used to produce the images on the image receiving surface of the casket. These media typically include ink, dye, wax, plastic, graphite, chalk, paint and charcoal. The media may also be in the form of a kit which could include decals and transfers. The media are introduced by a number of instruments including pens, pencils, crayons, ink markers, paint brushes and aerosol spray containers.

In the manner of the invention, a mourner may utilize an instrument, such as an ink marker, to bid a "final farewell" to the decedent by creating an image on the casket surface. The mourner may be free to either draw a picture, write text, or both. The mourner can also place a sticker on the surface.

The above description, as well as further objects, features and advantages of the present invention, will be more fully appreciated by reference to the following detailed description of the presently preferred, but nonetheless illustrative, embodiments in accordance with the present invention when taken in accordance with the accompanying drawings.

DESCRIPTION OF THE PREFERRED EMBODIMENTS

Figure 1:
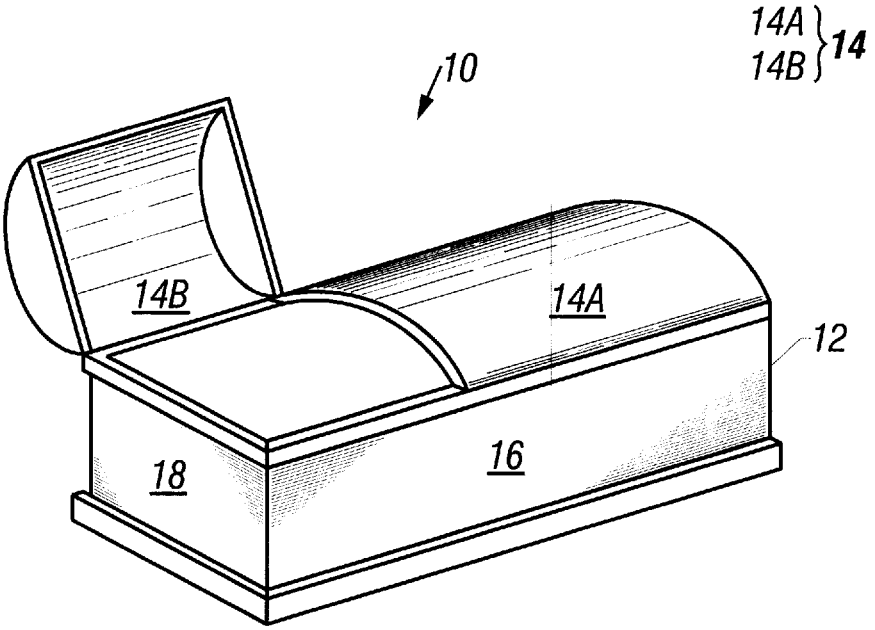
FIG. 1 is a perspective view of the inventive casket having an image receiving surface.
Figure 4:
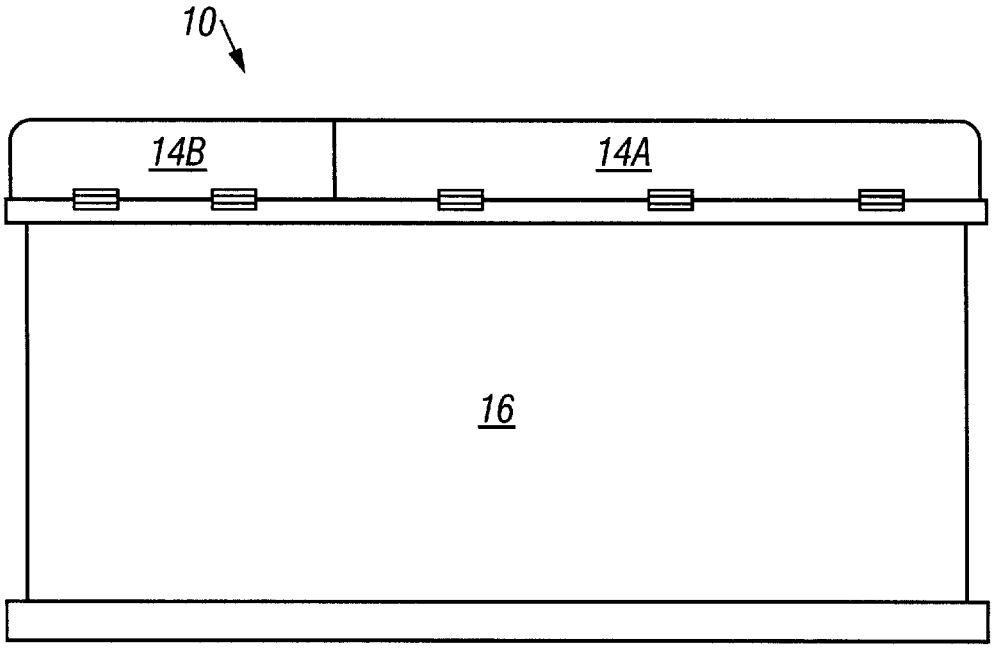
FIG. 4. is a side view of the casket showing the side opposite that shown in FIG. 1.

With reference to FIG. 1, one embodiment of the invention is illustrated therein and will be generally seen to include a burial casket 10 having an image receiving surface formed on the exterior surface of the casket. The burial casket 10 consists of two main components: a container 12 and a cover 14. The container has a generally rectangular central portion (not shown) which forms the bottom of the casket, side walls 16 which form the opposite sides of the casket, and end walls 18 which form opposite ends of the casket. As shown in FIG. 4, the cover 14 is connected by hinges to one of the side walls so that the cover 14 can be moved between an open position (FIG. 1), and a closed position (FIG. 4). The cover 14 overlies the end walls 18 and the side walls 16 so that the container 12 is completely enclosed when the cover 14 is in the closed position. The cover consists of two portions. The only difference in the portions is their length, with the portion 14A being longer than the portion 14B. When it is desired to see the upper torso of a decedent placed in the container, the portion 14B may be moved to the open position.

Figure 3:
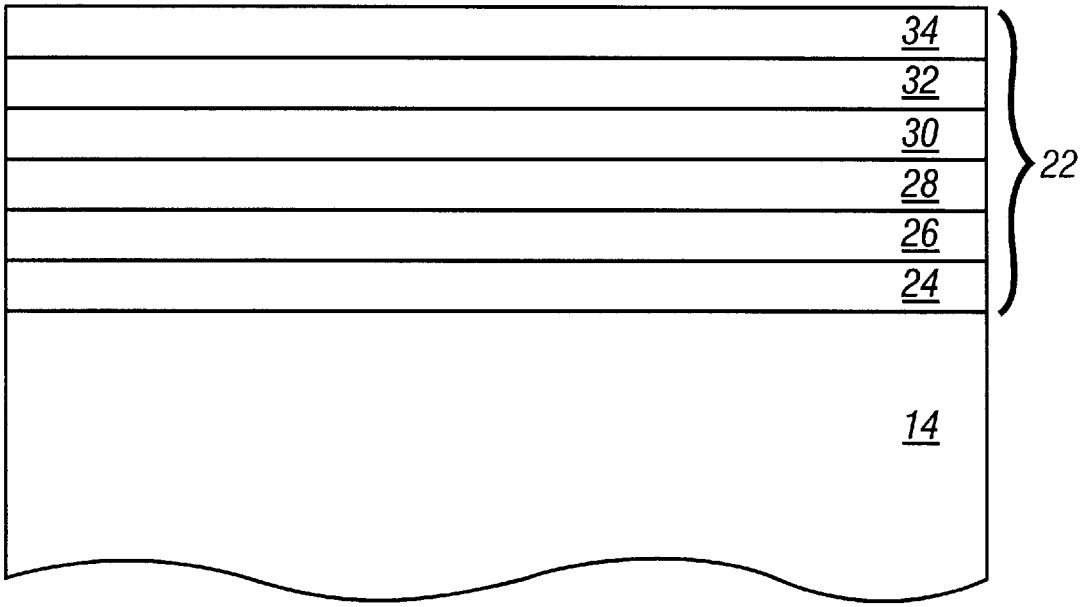
FIG. 3 is a cross-sectional view of a portion of the image receiving surface and a portion of the casket.

As shown in FIG. 3, the image receiving surface is a coating 22 formed on the exterior surface of the casket 10. In FIG. 3, the coating 22 is formed over a portion of the cover 14. The coating 22 consists of a stain, a shading toner, and a lacquer. Specifically, the coating includes one or more layers of stain 24 and 26 which are applied directly onto the exterior surface of the casket 10; a shading toner 28 applied on top of the stain 26; a lacquer sealer 30 applied on top of the shading toner 28; and one or more layers of gloss lacquer 32 and 34.

In one preferred embodiment, as shown in FIG. 3, the coating 22 consists of a first layer of stain 24, a glazing stain 26, a shading toner 28, a lacquer sealer 30, a first layer of gloss lacquer 32 and a second layer of gloss lacquer 34.

In another preferred embodiment, the first layer of stain 24 is a pearl essence stain, the glazing stain 26 is a semi-transparent white glazing stain 26, the shading toner 28 is a semi-transparent white shading toner, the lacquer sealer 30 is a satin sheen lacquer sealer and the first and second layers of gloss lacquer 32 and 34 are clear gloss lacquers. However, in this and in other preferred embodiments, it will be understood that the stain, the toner and the lacquer can be any color. Suitable sources of materials used for the coating of representative embodiments are available through Lawrence McFadden Co., located at 7430 State Road, Philadelphia, Pa. 19316.

The invention here also includes a method for applying the coating 22 to the exterior surface of the casket 10. The coating 22 is formed by applying the first layer of stain 24 on the exterior surface of the casket 10 and allowing the stain 24 to air dry. The glazing stain 26 is then applied on top of the first layer of stain 24, air dried, and wiped with a cloth. The shading toner 28 is then used to spot paint the glazing stain 26 in order to cover any dark spots where the casket 10 may show through the glazing stain 26. Next, the lacquer sealer 30 is applied on top of the toner 28. After the lacquer sealer 30 air dries, the exterior surface is scuff sanded and a first coat of gloss lacquer 32 is applied. After the first layer of gloss lacquer 32 has air dried, the casket is once again scuff sanded. Finally, a second layer of gloss lacquer 34 is applied and air dried. By using this method, a coating is formed on the exterior surface of the casket which is capable of receiving images.

The invention also consists of a number of different media which can be used to produce images of the image receiving surface. The various media include ink, dye, wax, plastic, graphite, chalk, paint and charcoal. The media comprise a kit which also include decals and transfers adapted to particular military experiences or professions. The media are capable of being introduced to the image receiving surface by a number of different instruments such as pens, pencils, crayons, ink markers, paint brushes and aerosol spray containers.

Figure 2:
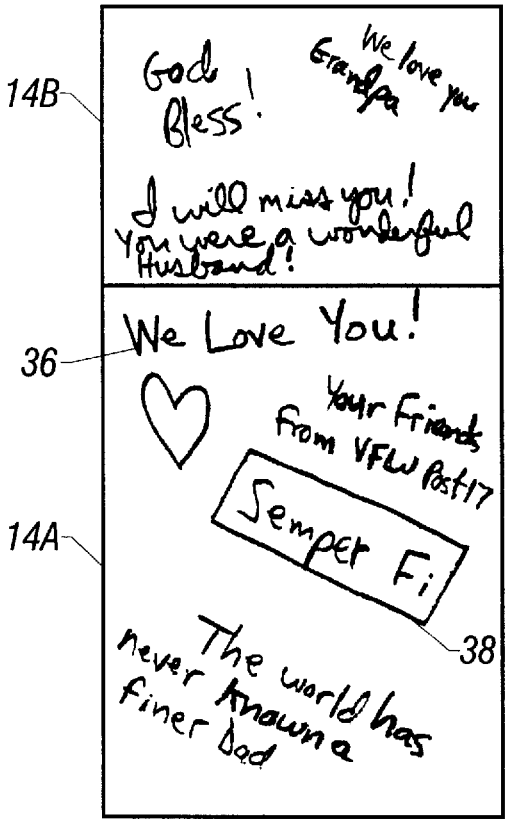
FIG. 2 is a top view of the casket shown in FIG. 1, after the casket has received a number of images.

Generally, after the coating 22 has been formed on the exterior surface of the casket 10, the various media are used to create images on the coating. FIG. 2 shows a representative sample of some of the images which could typically appear on the casket. As shown in FIG. 2, the image could be generated by writing a message such as "We Love You!" (designated by reference number 36) or placing a decal on the coating, e.g., the "Semper Fi!" sticker (designated by reference number 38). A mourner could also generate an image on the surface by applying the media with a paint brush or spray painting the message on the casket with an aerosol spray container. In any event, the image is intended to be permanent and will stay on the casket after the casket is entombed.

It will be appreciated that the departure from known prior art caskets and the attendant advantages provided by the instant invention lie in the ability to allow a mourner to spontaneously express his or her emotions in a graphic and personal manner. Unlike conventional caskets which may have a plaque or other icons placed on the casket surface, the casket of the present invention is dynamic in that the surface changes with each personalized message that individuals may wish to add. In this regard, the present invention also inherently provides an outlet for individuals to express their emotions during a psychologically trying period in a uniquely individualized manner.

While certain novel features of this invention have been shown and described and are pointed out in the annexed claims, it will be understood that various omissions, substitutions and changes in the forms and details of the device and method can be made by those skilled in the art without departing from the spirit of the invention.

We claim:

1. A burial casket having an image receiving surface comprising:

a container having a generally rectangular central portion forming the bottom of the casket, opposed end walls forming opposite ends of the casket, and opposed side walls forming opposite sides of the casket;

a cover which overlies the end walls and the side walls; and an image receiving coating applied to the exterior surface of the casket for receiving images, the coating including:

at least one layer of stain being applied directly to the exterior surface;

a shading toner adjacent the stain;

a lacquer sealer adjacent the shading toner, and at least one layer of gloss lacquer adjacent the lacquer sealer.

2. The burial casket of claim 1, wherein the at least one layer of stain is a pearl essence stain, the shading toner is a semi-transparent white shading toner, the lacquer sealer is a satin sheen lacquer sealer, and the gloss lacquer is a clear gloss lacquer.

3. In a bereavement casket including a container having a rectangular central portion forming the bottom of the casket, opposed end walls forming opposite ends of the casket, and opposed side walls forming opposite sides of the casket, and a cover which overlies the end walls and the side walls of the container, the improvement comprising:

a coating applied to the exterior surface of the casket for receiving images, the coating including:

at least one layer of stain being applied directly to the exterior surface;

a shading toner adjacent the stain;

a lacquer sealer adjacent the shading toner; and at least one layer of gloss lacquer adjacent the lacquer sealer.

4. The burial casket of claim 3, wherein the at least one layer of stain is a pearl essence stain, the shading toner is a semi-transparent white shading toner, the lacquer sealer is a satin sheen lacquer sealer, and the gloss lacquer is a clear gloss lacquer.

* * * * *